United States Patent [19]

Arai

[11] Patent Number: 4,907,299

[45] Date of Patent: Mar. 13, 1990

[54] SHIELD MOUNTING ASSEMBLY FOR A SAFETY HELMET

[76] Inventor: Michio Arai, 1-164 Horinouchi, Ohmiya-shi, Saitama-ken, Japan

[21] Appl. No.: 198,516

[22] Filed: May 25, 1988

[30] Foreign Application Priority Data

Jun. 9, 1987 [JP] Japan ..... 62-144450

[51] Int. Cl.[4] ..... A61F 9/06; A42B 1/08

[52] U.S. Cl. ..... 2/424

[58] Field of Search ..... 2/2.1 A, 5, 6, 9, 410, 2/424, 425

[56] References Cited

U.S. PATENT DOCUMENTS 4,612,675 9/1986 Broersma ..... 2/424

FOREIGN PATENT DOCUMENTS 2913059 10/1980 Fed. Rep. of Germany ..... 2/424
3015082 9/1981 Fed. Rep. of Germany ..... 2/425
1329759 8/1987 U.S.S.R. ..... 2/424
2103467 2/1983 United Kingdom ..... 2/410

*Primary Examiner*—Wm. Carter Reynolds
*Attorney, Agent, or Firm*—Klauber & Jackson

[57] ABSTRACT

A shield mounting assembly for a safety helmet having a helmet body and a front opening, includes an engaging base plate secured to left and right outer surfaces of the helmet body, each engaging base plate including a rotational axle with an engaging recess, a resilient engaging piece, a groove, and an engaging opening formed in the lower portion a shield is rotatably supported by the engaging base plates so as to cover the front opening in a closed position, each side of the shield including a mounting hole for receiving a respective rotational axle to rotatably support the shield on the engaging base plate, an arcuate guide opening for receiving a respective resilient engaging piece to limit rotation of the shield through a predetermined range of motion, and a lower peripheral edge which fits into the groove of the respective engaging base plates. A shield keep cover is detachably connected with an upper portion of each engaging base plate, each shield keep cover including a stopper operable from outside and being movable between positions into and removed from the engaging opening of a respective engaging base plate, and an engaging projecting portion which fits into the engaging recess of a respective engaging base plate through the mounting hole. The engaging projecting portion is disengageable from the engaging recess of a respective engaging base plate only when the shield is rotated so that each mounting hole is aligned at a predetermined rotational position with the respective rotational axle.

22 Claims, 3 Drawing Sheets

SHIELD MOUNTING ASSEMBLY FOR A SAFETY HELMET

BACKGROUND OF THE INVENTION

The present invention relates to an assembly for mounting a shield on a safety helmet having a full-face type or jet type configuration which is used when riding a motorcycle or driving an automobile.

In a conventional shield mounting construction for a safety helmet having a full-face type or jet type configuration, the shield and an opening adjustment means for the shield are generally mounted by set screws to the helmet body. More specifically, left and right sides of the shield and parts of the opening adjustment means, such as a ratchet mechanism, are fixedly mounted to the helmet body through a mounting cover.

With the above-mentioned conventional construction, it is sometimes necessary to disassemble a mounting portion of the shield because the shield does not open and close correctly during use. In such case, when the set screws are removed to remove the shield mounting cover from the helmet body, various parts thereof which limit the opening and closing of the shield, fly apart in a disorderly manner. As a result, these parts may be lost.

In addition, with such conventional shield mounting construction, removal of the shield can be performed at a position in which the shield is in its normal operational state, that is, at any position from a fully closed position to a fully open position. Therefore, if the set screws become loose, the shield can possibly separate from the helmet body even during a period of operation thereof.

OBJECTS AND SUMMARY OF THE INVENTION

Accordingly, it is an object of the present invention to provide a mounting construction for a shield of a safety helmet that overcomes the aforementioned problems in the prior art.

It is another object of the present invention to provide such a mounting construction in which the shield can be engaged with and held on the helmet body without the use of set screws.

It is still another object of the invention to provide such a mounting construction in which mounting and removal of the shield keep cover and shield can be performed only when the shield is moved to a predetermined position.

It is yet another object of the invention to provide such a mounting construction in which, even if the shield keep cover and shield are removed from the helmet body, support members for the shield do not fly apart in pieces.

In accordance with an aspect of the present invention, a shield mounting assembly for a safety helmet of the type having a helmet body and a front opening, includes:

(a) an engaging base plate secured to left and right outer surfaces of the helmet body, each engaging base plate including a rotational axle, each rotational axle including an engaging recess therein;

(b) a shield rotatably supported by the left and right engaging base plates through a predetermined range of motion so as to cover the front opening in a closed position, the shield having left and right sides, each side including a mounting hole for receiving the rotational axle of a respective engaging base plate to rotatably support the shield on the engaging base plate;

(c) a shield keep cover detachably connected with an upper portion of each engaging base plate, each shield keep cover including an engaging projecting portion which fits into the engaging recess of a respective engaging base plate through the mounting hole, the engaging projecting portion being capable of being disengaged from the engaging recess of a respective engaging base plate only when the shield is rotated so that each mounting hole is aligned at a predetermined rotational position with the respective rotational axle; and (d) rotation limiting means for limiting rotation of the shield through the predetermined range of motion.

In accordance with another aspect of the present invention, a shield mounting assembly for a safety helmet of the type having a helmet body and a front opening, includes:

(a) an engaging base plate secured to left and right outer surfaces of the helmet body, each engaging base plate including:

(i) a rotational axle, the rotational axle including an upper peripheral surface having an engaging recess therein;

(ii) a groove; and (iii) an engaging opening formed in a lower portion thereof;

(b) a shield rotatably supported by the left and right engaging base plates through a predetermined range of motion so as to cover the front opening in a closed position, the shield having left and right sides, each side including:

(i) a mounting hole for receiving the rotational axle of a respective engaging base plate to rotatably support the shield on the engaging base plate; and (ii) a lower peripheral edge which fits into the groove of a respective engaging base plate;

(c) a shield keep cover detachably connected with an upper portion of each engaging base plate, each shield keep cover including:

(i) a stopper operable from outside a respective shield keep cover, the stopper being movable between a position into the engaging opening of a respective engaging base plate and a position removed from the engaging opening; and (ii) an engaging projecting portion which fits into the engaging recess of a respective engaging base plate through the mounting hole, the engaging projecting portion being capable of being disengaged from the engaging recess of a respective engaging base plate only when the shield is rotated so that each mounting hole is aligned at a predetermined rotational position with the respective rotational axle; and (d) rotation limiting means for limiting rotation of the shield through the predetermined range of motion.

The above and other objects, features and advantages of the present invention will become readily apparent from the following detailed description thereof which is to be read in connection with the accompanying drawings.

DETAILED DESCRIPTION OF A PREFERRED EMBODIMENT

Figure 1:
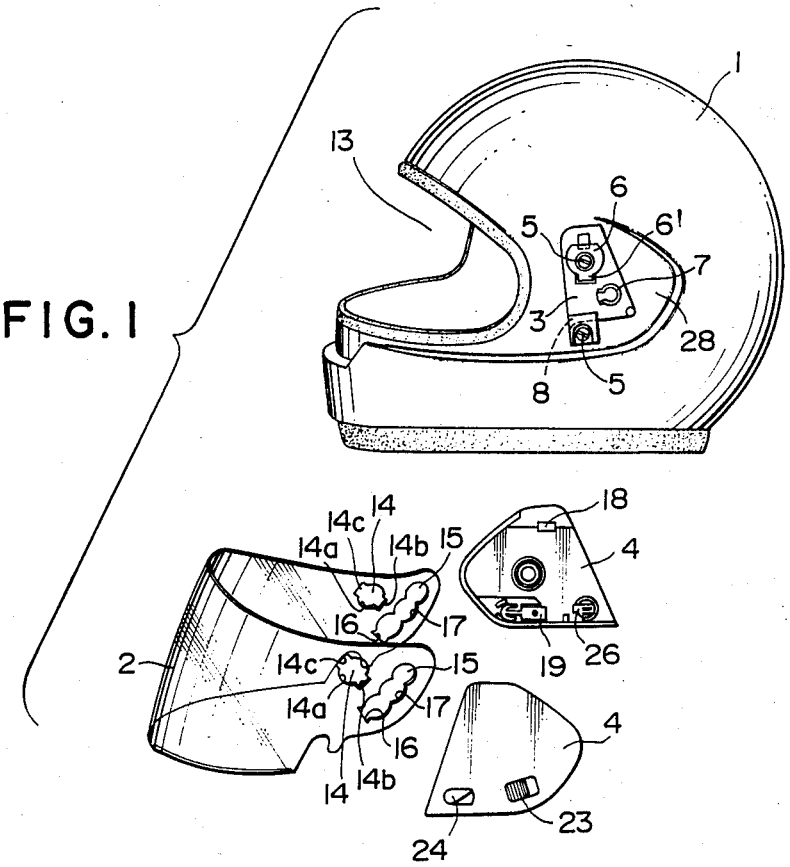
FIG. 1 is an exploded perspective view of a helmet according to the present invention.
Figure 2:
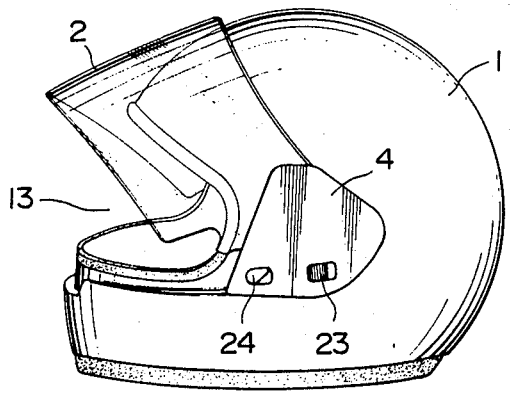
FIG. 2 is a perspective view of the helmet of FIG. 1, shown in assembled condition.

An embodiment of a mounting construction for a shield of a safety helmet according to the present invention will now be described with reference to the drawings, in which there is shown a helmet body 1, a shield 2, an engaging base plate 3 secured to left and right outer surfaces of helmet body 1, and a shield keep cover 4.

Helmet body 1 is shown with a full-face type configuration, which is generally known. However, helmet body 1 can have a jet type configuration. Engaging base plates 3 are provided to support shield 2 and are fixed by set screws 5 to the left and right outer sides of helmet body 1. Each engaging base plate 3 is integrally provided with a rotation axle 6 about which shield 2 is rotated, a resilient engaging piece 7 for limiting rotation of shield 2 and a groove 8 into which the lower peripheral edge of shield 2 fits, resilient engaging piece 7 being disposed below rotation axle 6, and groove 8 disposed further below thereof. Each engaging base plate 3 can be molded of either synthetic resin or a metal. In the case where engaging base plates 3 are formed of synthetic resin, a moderating means for limiting rotation of shield 2 can additionally be integrally formed therewith.

Figure 8:
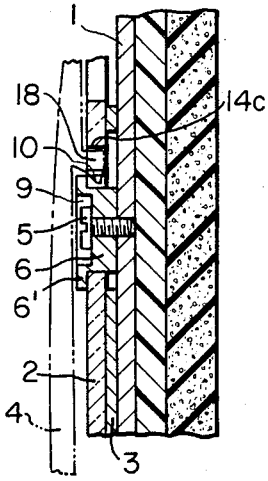
FIG. 8 is a cross-sectional view of the mounting assembly of FIG. 3, taken along line 8—8 thereof.

Rotation axle 6 includes a projecting piece 6′ formed opposite to the upper cut-off straight line surface of rotation axle 6. The projected height of rotation axle 6 is about twice that of the plate thickness of shield 2, such that projecting piece 6′ which projects from the outer peripheral surface of rotation axle 6 extends to a position above the plate thickness of shield 2, as best shown in FIG. 8. Rotation axle 6 is formed at its central portion with a through hole into which a set screw 5 is inserted, and a recess 9 (FIG. 8) which receives the head of set screw 5 is formed at the upper side of the through hole. Further, rotation axle 6 is formed on the side of the upper straight line surface with an engaging recess 10, which receives an engaging projecting portion 18 of shield keep cover 4.

Resilient engaging piece 7 is formed into an approximately C-shape by cutting off a part of a circular ring. A part of the outer peripheral surface of resilient engaging piece 7 is connected to base plate 3, and a pawl portion 7′ is integrally formed at opposite ends of resilient engaging piece 7 and is directed radially outwardly.

Figure 3:
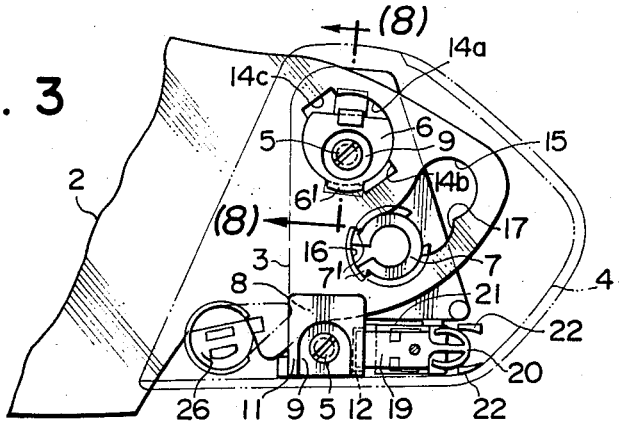
FIG. 3 is an enlarged plan view, partly in phantom, of the mounting assembly of the helmet of FIG. 1, showing the shield in a fully closed position.
Figure 4:
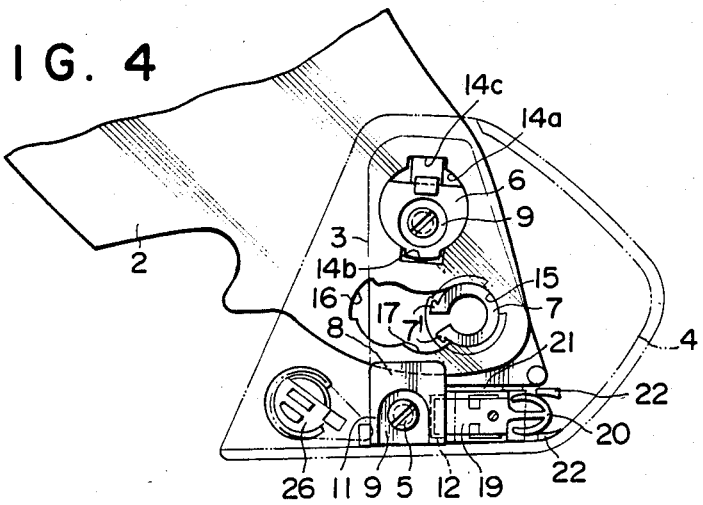
FIG. 4 is an enlarged plan view, partly in phantom, of the mounting assembly of FIG. 3, showing the shield in a fully opened position, and the stopper engaged within the engaging hole.
Figure 5:
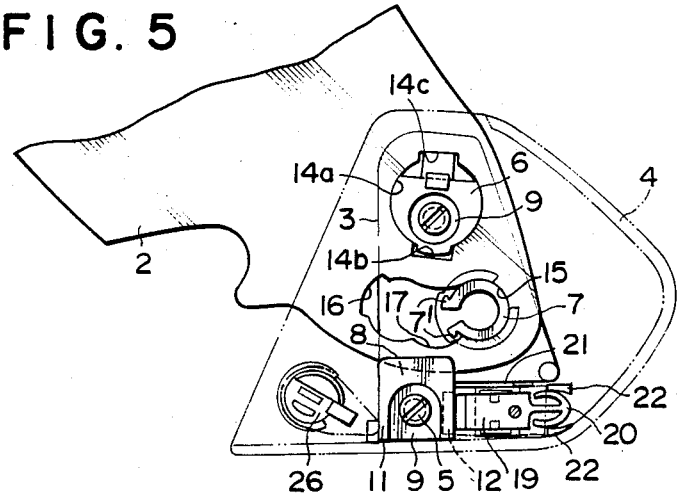
FIG. 5 is an enlarged plan view, partly in phantom, of the mounting assembly of FIG. 3, showing the shield in a fully opened position, with the stopper being removed from the engaging hole.

Groove 8 is positioned at the lower end of base plate 3 and has a width capable of receiving the plate thickness of shield 2. Specifically, the upper and both left and right sides of groove 8 are open, such that the lower peripheral edge of shield 2 is inserted in groove 8 from the top thereof and guided in a lateral direction, as shown in FIGS. 3–5.

An extension 11 formed with a through hole for receiving a set screw 5 is integrally formed at the lower part of each engaging base plate 3, and an engaging hole 12 is formed in a rear, external end portion of extension 11.

Shield 2 opens and closes a front opening or window hole 13 formed in the front surface of helmet body 1 and is formed from a transparent, translucent or colored transparent synthetic resin plate which is adjusted to the curved shape of helmet body 1. Shield 2 is formed at both left and right sides thereof with a mounting hole 14 through which rotation axle 6 and projecting piece 6′ fit, and an arcuate guide hole 15 which receives resilient engaging piece 7 to determine the range of rotation of shield 2.

Mounting hole 14 is continuously formed with a circular hole 14*a* slightly larger than the outer diameter of axle 6 and a notch 14*b* at the lower hole edge of hole 14*a* which receives projecting piece 6′. Hole 14*a* is also continuously formed at the upper peripheral edge thereof with a notch 14*c* which receives engaging projecting portion 18 formed on shield keep cover 4 when shield 2 is moved to its upper limit position.

Arcuate guide hole 15 determines the range of rotation of shield 2 and is formed arcuately in surrounding relation about mounting hole 14. Guide hole 15 is formed with a fitting portion 16 at one end thereof, fitting portion 16 engaged With pawl 7′ of resilient engaging piece 7 when shield 2 is closed. The width of arcuate guide hole 15 is slightly narrower than the outside diameter of resilient piece 7 when no external force is exerted. A depression 17 is formed halfway along guide hole 15. Accordingly, when shield 2 is rotated so that depression 17 in guide hole 15 assumes the position of resilient engaging piece 7, the inwardly compressed resilient engaging piece 7 expands into its no-load shape and fits into depression 17. Therefore, shield 2 is engaged and held at a predetermined open position. Thus, shield 2 can be opened and closed in a stepwise manner.

Shield keep cover 4 for covering the support portion of shield 2 is formed of a synthetic resin material, and engaging projecting portion 18 is integrally formed at the upper part of the inner surface thereof in opposing relation to shield 2. In addition, a stopper 19 is mounted at the lower part of the inner surface so that it may be operated from the outside.

Engaging projecting portion 18 fits into and engages with engaging recess 10 formed in the upper side of rotation axle 6 of engaging base plate 3, engaging projecting portion 18 fitting into and disengaging from engaging recess 10 through notch 14*c* formed in the upper peripheral edge of mounting hole 14*a* when rotation axle 6 registers with mounting hole 14*a* of shield 2, that is, in the fully open limit position of shield 2. The lower portion of engaging projection portion 18 is slotted to allow insertion of this lower portion into recess 10 of axle 6, as shown in FIG. 8.

Figure 6:
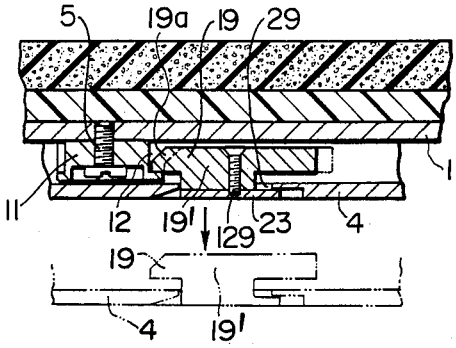
FIG. 6 is a cross-sectional view of a portion of the helmet of FIG. 1, showing the stopper of the shield keep cover engaged in the engaging hole of the engaging base plate.
Figure 7:
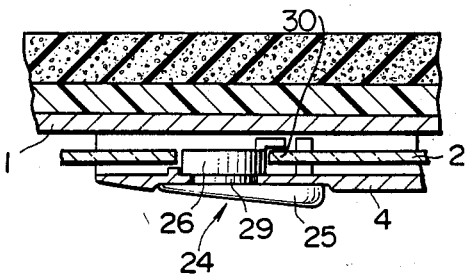
FIG. 7 is a cross-sectional view of a portion of the helmet of FIG. 1, showing the lock mechanism for maintaining the shield in its fully closed position.

Stopper 19 is in the form of a rectangular flat plate section and the inside surface at the rear end 19*a* thereof which fits into and disengages from engaging hole 12 is formed with an inclined surface, as shown in FIG. 6. At the opposite front side thereof, stopper 19 is projectingly formed with a spring-action piece 20 in the form of an arrow for biasing stopper 19 in a direction of being fit into engaging hole 12 at all times. The thus formed stopper 19 fits into a guide piece 21 formed in the back of shield keep cover 4, and spring-action piece 20 thereof fits into a guide piece 22 that narrows toward the rear of shield keep cover 4. Spring-action piece 20 is moved in the direction of the narrowing width of guide piece 22, whereby spring-action piece 20 is inwardly pressed to store a bias force. When the rearwardly moving force is released, stopper 19 is thereby moved by such stored bias force in the opposite direction so as to automatically engage and fit into engaging hole 12.

A projection 19' formed on the outer surface of stopper 19 fronts into a guide hole 29 formed in shield keep cover 4 and is supported slidable left and right therein, as viewed in FIG. 6. An operating plate 23 is joined to projection 19' from the outside of cover 4 and fixed by a set screw 129 so that removal of stopper 19 may be accomplished from the outside.

A lock mechanism 24 is mounted on shield keep cover 4 for maintaining shield 2 in a closed position. Lock mechanism 24 is composed of a lock cam 26 which rotates integral with an operating lever 25 on shield keep cover 4, and an engaging portion 30 of shield 2 which can be engaged with and disengaged from lock cam 26, as shown in FIGS. 3–5 and 7.

Figure 9:
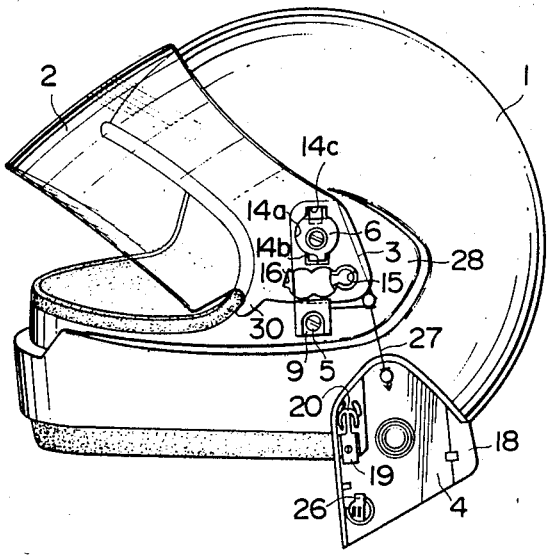
FIG. 9 is a perspective view of the helmet of FIG. 1, showing the shield keep cover disassembled from the helmet, but connected by means of a string.

Shield keep cover 4 is connected to engaging base plate 3 which is secured to helmet body 1, by a flexible connecting string 27 (FIG. 9), for example, a plastic string, to prevent shield keep cover 4 from being completely separated when shield keep cover 4 is disassembled.

The mounting position of engaging base plate 3 relative to helmet body 1 can be on the curved side surface of helmet body 1, as shown, although an offset portion 28 (FIGS. 1 and 9) much lower than such shown curved side surface can be used. In such case, if engaging base plate 3 is secured to offset portion 28 and shield keep cover 4 is engaged therewith so that the outer surface of shield keep cover 4 and the outer surface of helmet body 1 approximately face each other, it is possible to minimize the amount of projection of the outer surface of the helmet.

Next, mounting of shield 2 will be described. First, the left and right sides of shield 2 are engaged with and supported on engaging base plates 3 secured to helmet body 1, such support thereof being set by fitting the lower peripheral edge of shield 2 into groove 8 and fitting and registering the mounting hole 14 and circular guide hole 15 onto axle 6 and resilient engaging piece 7, respectively. In such case, shield 2 is in its upper open limit position.

Thereafter, engaging projecting portion 18 of shield keep cover 4 is fitted into and engaged with engaging recess 10 on the upper side of axle 6 through notch 14c formed in the edge of mounting hole 14 of shield 2. Stopper 19 provided at the underside of shield keep cover 4 is biased and fits into engaging hole 12 formed at the lower part of engaging base plate 3 by means of operating member 23 so that shield keep cover 4 and engaging base plate 3 are integrally engaged and held with each other, thus completing the mounting of shield 2. Thereafter, shield 2 is closed for use.

To remove shield 2, shield 2 is rotated upwardly so that mounting hole 14 is placed in registration with axle 6, and in that state, stopper 19 provided on shield keep cover 4 is pulled out of engaging hole 12, and shield keep cover 4 is raised upwardly so as to be pulled out of helmet body 1. Engaging projecting portion 18 is then removed from engaging recess 10 through notch 14c whereby shield keep cover 4 may be removed. Thereafter, shield 2 can be disengaged from engaging base plate 3.

Thus, with the present invention, shield 2 may be mounted for limited rotation by engagement between engaging base plates 3 secured to the sides of helmet 1 and shield keep covers 4, without the use of set screws. Further, since such support is accomplished by engaging base plates 3 secured to the sides of helmet 1 and shield keep covers 4 which can b engaged and disengaged therefrom, even if shield keep covers 4 are removed from engaging base plates 3 to remove shield 2, such supporting members do not completely separate from each other, that is, do not fly apart in pieces, so that shield 2 may be engaged and disengaged safely. Moreover, since the mounting and removal of shield 2 and shield keep covers 4 can be effected only when shield 2 is rotated to its upper limit position, shield keep covers 4 and shield 2 are opposed to each other when shield 2 is fully closed, to prevent disengagement thereof. Therefore, there is no possible disengagement of shield 2 in such position.

Having described a specific preferred embodiment of the invention with reference to the accompanying drawings, it will be appreciated that the present invention is not limited to that precise embodiment, and that various changes and modifications can be effected therein by one of ordinary skill in the art without departing from the spirit or scope of the invention, as defined by the appended claims.

What is claimed is:

1. A shield mounting assembly for a safety helmet of the type having a helmet body and a front opening, said assembly comprising:

(a) a left engaging base plate secured to a left outer surface of the helmet body, said left engaging base plate including a rotational axle, said rotational axle including an engaging recess therein;

(b) a right engaging base plate secured to a right outer surface of the helmet body, said right engaging base plate including a rotational axle, said rotational axle including an engaging recess therein;

(c) a shield rotatably supported by said left and right engaging base plates through a predetermined range of motion so as to cover the front opening in a closed position, said shield having left and right sides, each side including a mounting hole for receiving the rotational axle of a respective engaging base plate to rotatably support said shield on said engaging base plate;

(d) a shield keep cover detachably connected with an upper portion of each said engaging base plate, each said shield keep cover including an engaging projecting portion which fits into the engaging recess of a respective engaging base plate through the mounting hole, the engaging projecting portion being capable of being disengaged from the engaging recess of a respective engaging base plate only when the shield is rotated so that each mounting hole is aligned at a predetermined rotational position with the respective rotational axle; and (e) rotation limiting means for limiting rotation of said shield through said predetermined range of motion.

2. A shield mounting assembly according to claim 1; wherein said rotation limiting means includes a resilient engaging piece on at least one of said left and right engaging base plates, and at least one arcuate guide opening formed in said shield for receiving each resilient engaging piece to limit rotation of said shield through said predetermined range of motion.

3. A shield mounting assembly according to claim 2; wherein each resilient engaging piece is formed into a substantially C configuration; and each arcuate guide opening is formed with different widths thereof to maintain said resilient engaging piece, and thereby said shield, in a selected one of a plurality of different arcuate positions.

4. A shield mounting assembly according to claim 2; wherein each resilient engaging piece includes a pawl portion; and each arcuate guide opening includes fitting portion means for receiving said pawl portion in a releasable locking manner so as to releasably lock said shield in a closed position.

5. A shield mounting assembly according to claim 1; wherein at least one of said left and right engaging base plates includes a groove for slidable receiving a lower peripheral edge of said shield therein so as to guide said shield during rotational movement thereof.

6. A shield mounting assembly according to claim 5; wherein each groove is open at an upper portion and side portions thereof to permit slidable movement of said lower peripheral edge of said shield therein.

7. A shield mounting assembly according to claim 1; wherein at least one of said left and right engaging base plates includes an engaging opening formed in a lower portion thereof; and at least one shield keep cover includes a stopper operable from outside the respective shield keep cover and movable between a position into the engaging opening of a respective engaging base plate and a position removed from said engaging opening.

8. A shield mounting assembly according to claim 7; wherein each stopper includes a plate section movable into the engaging opening of a respective engaging base plate and biasing section means connected with said plate section for biasing said plate section into the engaging opening.

9. A shield mounting assembly according to claim 8; wherein said plate section is in the form of a rectangular flat plate.

10. A shield mounting assembly according to claim 8; wherein each respective shield keep cover includes just guide piece means for slidable guiding said plate section and second guide piece means for receiving and biasing said biasing section means to move said plate section into the engaging opening of a respective engaging base plate.

11. A shield mounting assembly according to claim 1; wherein at least one said shield keep cover includes lock means for maintaining said shield in a closed position.

12. A shield mounting assembly according to claim 11; wherein said lock means includes a lock cam rotatable between a first unlocking position and a second locking position in engagement with an engaging portion of said shield, and operating lever means for moving said lock cam between said unlocked and locked positions.

13. A shield mounting assembly for a safety helmet of the type having a helmet body and a front opening, said assembly comprising:

(a) a left engaging base plate secured to a left outer surface of the helmet body, said left engaging base plate including:
  (i) a rotational axle, said rotational axle including an upper peripheral surface having an engaging recess therein;
  (ii) a groove; and
  (iii) an engaging opening formed in a lower portion thereof;

(b) a right engaging base plate secured to a right outer surface of the helmet body, said right engaging base plate including:
  (i) a rotational axle, said rotational axle including an upper peripheral surface having an engaging recess therein;
  (ii) a groove; and
  (iii) an engaging opening formed in a lower portion thereof;

(c) a shield rotatably supported by the left and right engaging base plates through a predetermined range of motion so as to cover said front opening a closed position, said shield having left and right sides, each side including:
  (i) a mounting hole for receiving said rotational axle of a respective engaging base plate to rotatably support said shield on said engaging base plate; and
  (ii) a lower peripheral edge which fits into the groove of a respective engaging base plate;

(d) a shield keep cover detachably connected with an upper portion of each said engaging base plate, each said shield keep cover including:
  (i) a stopper operable from outside a respective shield keep cover, said stopper being movable between a position into the engaging opening of a respective engaging base plate and a position removed from said engaging opening; and
  (ii) an engaging projecting portion which fits into the engaging recess of a respective engaging base plate through said mounting hole, the engaging projecting portion being capable of being disengaged from the engaging recess of a respective engaging base plate only when the shield is rotated so that each mounting hole is aligned at a predetermined rotational position with the respective rotational axle; and (e) rotation limiting means for limiting rotation of said shield through the predetermined range of motion.

14. A shield mounting assembly according to claim 13; wherein said rotation limiting means including a resilient engaging piece on at least one of said left and right engaging base plates, and at least one arcuate guide opening formed in said shield for receiving each resilient engaging piece to limit rotation of said shield through said predetermined range of motion.

15. A shield mounting assembly according to claim 14; wherein each resilient engaging piece is formed into a substantially C configuration; and each arcuate guide opening is formed with different widths thereof to maintain said resilient engaging piece, and thereby said shield, in a selected one of a plurality of different arcuate positions.

16. A shield mounting assembly according to claim 14; wherein each resilient engaging piece includes a pawl portion; and each arcuate guide opening includes fitting portion means for receiving said pawl portion in a releasable locking manner so as to releasably lock said shield in a closed position.

17. A shield mounting assembly according to claim 13; wherein each groove is open at an upper portion and side portions thereof to permit slidable movement of said lower peripheral edge of said shield therein.

18. A shield mounting assembly according to claim 13; wherein each stopper includes a plate section movable into the engaging opening of a respective engaging base plate and biasing section means connected with said plate section for biasing said plate section into the engaging opening.

19. A shield mounting assembly according to claim 18; wherein said plate section is in the form of a rectangular flat plate.

20. A shield mounting assembly according to claim 18; wherein each respective shield keep cover includes first guide piece means for slidably guiding said plate section and second guide piece means for receiving and biasing said biasing section means to move said plate section into the engaging recess of a respective engaging base plate.

21. A shield mounting assembly according to claim 13; wherein at least one said shield keep cover includes lock means for maintaining said shield in a closed position.

22. A shield mounting assembly according to claim 21; wherein said lock means includes a lock cam rotatable between a first unlocking position and a second locking position in engagement with an engaging portion of said shield, and operating lever means for moving said lock cam between said unlocked and locked positions.

* * * * *